United States Patent [19]

Sung et al.

[11] Patent Number: 4,548,616

[45] Date of Patent: Oct. 22, 1985

[54] GASOLINE CONTAINING AS ADDITIVE POLY(OXYETHYLENE) POLY(OXYPROPYLENE) POLY(OXYETHYLENE) POLYOL TO REDUCE OCTANE REQUIREMENT INCREASE

[75] Inventors: Rodney L. Sung, Fishkill; Marshall E. Davis, Poughkeepsie, both of N.Y.

[73] Assignee: Texaco Inc., White Plains, N.Y.

[21] Appl. No.: 620,656

[22] Filed: Jun. 14, 1984

[51] Int. Cl.[4] ..... C10L 1/18

[52] U.S. Cl. ..... 44/77

[58] Field of Search ..... 44/77, 56

[56] References Cited

U.S. PATENT DOCUMENTS

| | | | |
|---|---|---|---|
| 2,563,101 | 8/1951 | Colwell et al. | 44/77 |
| 2,807,525 | 9/1957 | Foreman | 44/77 |
| 2,853,530 | 9/1958 | Banigan, Jr. | 44/77 |
| 2,920,948 | 1/1960 | Weeks | 44/77 |
| 4,252,540 | 2/1981 | Yamamura et al. | 44/77 |
| 4,276,054 | 6/1981 | Schmolka et al. | 44/77 |

*Primary Examiner*—Y. Harris-Smith

*Attorney, Agent, or Firm*—Robert A. Kulason; James J. O'Loughlin; Carl G. Seutter

[57] ABSTRACT

Gasoline of reduced octane requirement increase is attained by addition of, as additive, a poly(oxyethylene) poly(oxypropylene) poly(oxyethylene) polyol.

19 Claims, No Drawings

20

GASOLINE CONTAINING AS ADDITIVE POLY(OXYETHYLENE) POLY(OXYPROPYLENE) POLY(OXYETHYLENE) POLYOL TO REDUCE OCTANE REQUIREMENT INCREASE

FIELD OF THE INVENTION

This invention relates to hydrocarbon fuels boiling in the gasoline boiling range. More particularly it relates to a gasoline characterized by a reduced octane requirement increase.

BACKGROUND OF THE INVENTION

As is well known to those skilled in the art, deposits form in the combustion chamber of an internal combustion engine as a result of incomplete combustion of the mixture of air, fuel, and oil. This is particularly true in the case of cars which operate on unleaded fuels. After a few thousand miles of operation, the deposits are of such a level that the performance of the engine decreases. Specifically, when the charge gasoline is of constant octane number, the power output decreases. In order to maintain the power output at a predetermined desired level, it is necessary to increase the octane number of the fuel over the course of time. This Octane Requirement Increase (ORI) is clearly undesirable.

It is an object of this invention to provide a fuel boiling in the gasoline boiling range which is characterized by a decreased octane requirement increase. Other objects will be apparent to those skilled in the art.

STATEMENT OF THE INVENTION

In accordance with certain of its aspects, this invention is directed to a fuel composition comprising (i) a major portion of a liquid hydrocarbon fuel boiling in the gasoline boiling range; and (ii) a minor effective amount, as additive, of $$HO(CH_2CH_2O)_a(\underset{\underset{CH_3}{|}}{C}HCH_2O)_b(CH_2CH_2O)_cH$$

wherein a+c is 1–11.

b is 5–50.

and the molecular weight $\overline{M}_n$ of said additive is 800–2000.

DESCRIPTION OF THE INVENTION

The hydrocarbon fuels which may be treated by the process of this invention include liquid hydrocarbon fuels boiling in the gasoline boiling range. Commonly these fuels may be characterized as follows:

TABLE

| Property | Broad | Preferred | Typical |
|---|---|---|---|
| ibp (°F.) | 80–100 | 85–95 | 92 |
| 50% bp (°F.) | 150–300 | 200–250 | 216 |
| 90% bp (°F.) | 300–450 | 330–400 | 334 |
| API Gravity | 50–65 | 55–60 | 61 |

These fuels may be fully formulated gasoline compositions (containing standard commercial additive packages) having a road octane number (RON) of 80–98, preferably 85–95, say 93 and a motor octane number (MON) of 75–95, preferably 80–90, say 83. The fuels may be summer or winter grades, high or low octane, leaded or unleaded, etc. Unleaded gasolines may particularly benefit from practice of this invention.

The additives which may be employed in practice of this invention may be characterized as alpha-hydro-omega-hydroxy-poly (oxyethylene) poly (oxypropylene) poly (oxyethylene) block polymers. These additives may be prepared by the reaction of ethylene oxide with a poly (oxypropylene) glycol in the presence of a basic catalyst. They may be characterized by the formula $$HO(CH_2CH_2O)_a(\underset{\underset{CH_3}{|}}{C}HCH_2O)_b(CH_2CH_2O)_cH$$

wherein a+c is 1–11, preferably 2–5, say 2.2; and b is 5–50, preferably 10–20, say 14.7. These additives may have a molecular weight $\overline{M}_n$ of 800–2000, preferably 900–1800, say 950.

These additives may be available from Wyandotte Chemicals Corp. under the Pluronic trademark. Typical commercial available additives may be those in the following table, the first-listed being preferred:

TABLE

A. The Wyandotte Pluronic L-31 brand of poly (oxyethylene) poly (oxypropylene) poly (oxyethylene) polyol having a molecular weight $\overline{M}_n$ of 950 and containing 10 w % derived from poly (oxyethylene) and 90 w % derived from poly (oxypropylene). In this product, b is 14.7 and a+c is 2.2.

B. The Wyandotte Pluronic L-63 brand of poly (oxyethylene) poly (oxypropylene) poly (oxyethylene) polyol having a molecular weight $\overline{M}_n$ of 1750 and containing 30 w % derived from poly (oxyethylene) and 70 w % derived from poly (oxypropylene). In this product, b is 21.1 and a+c is 11.9.

C. The Wyandotte Pluronic L-62 brand of poly (oxyethylene) poly (oxypropylene) poly (oxyethylene) polyol having a molecule weight $\overline{M}_n$ of 1750 and containing 20 w % desired from poly (oxyethylene) and 80 w % derived from poly (oxypropylene). b is 24.1 and a+c is 8.

D. The Wyandotte Pluronic L-43 brand of poly (oxyethylene) poly (oxypropylene) poly (oxyethylene) polyol having a molecule weight $\overline{M}_n$ 1200 and containing 30 w % derived from poly (oxyethylene) and 70 w % derived from poly (oxypropylene). b is 16.6 and a+c is 5.5.

E. The Wyandotte Pluronic L-64 brand of poly (oxyethylene) poly (oxypropylene) poly (oxyethylene) polyol having a molecule weight $\overline{M}_n$ 1750 and containing 40 w % derived from poly (oxyethylene) and 60 w % derived from poly (oxypropylene). b is 18.1 and a+c is 15.9.

In practice of the process of this invention, these additives may be present in a liquid hydrocarbon fuel composition in amount of 0.06–0.9 w %, preferably 0.12–0.6 w %, say about 0.3 w %. This corresponds to 20–300 PTB, preferably 40–200 PTB, say 100 PTB. PTB is an abbreviation for pounds per thousand barrels.

Illustrative formulations may include the following:

TABLE

1. A fully formulated unleaded summer grade gasoline (containing a full line of additives) including a hydrocarbon of ibp of 84° F., 50% bp of 218° F., 90% bp of 344° F., and API Gravity of 58.4 containing 100 PTB of the Pluronic L-31 brand of additive A of the table supra. (q.v. Example II infra);

2. A fully formulated leaded summer grade gasoline (containing a full line of additives) including a hydrocarbon of ibp of 84° F., 50% bp of 201° F., 90% bp of 343° F., and API Gravity of 61.5 containing 100 PTB of the Pluronic L-63 brand of additive B of the table supra. (q.v. Example III infra);

3. A fully formulated leaded winter grade gasoline (containing a full line of additives) including a hydrocarbon of ibp of 80° F., 50% bp of 192° F., 90% bp of 334° F., and API Gravity of 63.8 containing 100 PTB of the Pluronic L-31 brand of additive A of the table supra.

4. A fully formulated unleaded winter grade gasoline (containing a full line of additives) including a hydrocarbon of ibp of 79° F., 50% bp of 205° F., 90% bp of 336° F. and API Gravity of 61.5 containing 100 PTB of Pluronic L-63 additive B of the Table supra.

It is a feature of this invention that the products containing effective amounts of the additives are characterized by improved (i.e. reduced) Octane Requirement Increase (ORI). Under operating conditions it is not uncommon for the ORI to increase by as much as 5 units (or even more) after 144 hours of operation. By practice of this invention, it is possible to decrease this ORI by 20%-40% i.e. to a value of 3-4 units.

STANDARD TEST FOR OCTANE REQUIREMENT INCREASE (ORI)

The test facility uses a closed air system with fuel introduced to the engine by a pneumatic atomizing spray nozzle. Before entering the engine, the air is filtered and treated by (in order): a gel, oil vapor remover, and Ultipore filter to ensure that the engine charge air contains minimum amounts of water, oil droplets, and vapors. Engine air measured by a sharp edged orifice, is heated in a surge tank and mixed with the fuel near the engine intake port. Fuel flow is measured with a Cox Instruments Flow Meter. The fuel and air systems provide close control, at the intake, of charge to the engine under cycling conditions and during octane rating of the engine. The increase in octane requirements of the engine ORI (for a fuel and/or lubricant system,) is a function of the fuel and/or lubricant. If the rating conditions (such as mixture temperature, intake charge rate, coolant temperature, engine speed, etc. which affect the state of product gases) are kept constant from one rating to the next any change in the state of the end gases will result from a change in combustion chamber deposits. The octane requirement of the engine will increase as the deposits accumulate; eventually the octane requirement will stabilize with the stabilization of combustion chamber deposits. The test results are reported after the ORI is stabilized which requires varying amounts of time depending on the fuel tested. The ORI reported is the difference between the final and initial values with a lower difference signifying improved performance.

It is also a feature of this invention that the novel compositions perform favorably when tested by the Combustion Chamber Deposit Screening Test (CCDST). In this test, the deposit-forming tendencies of a gasoline are measured; and the amount of deposit correlates with the ORI. The amount of deposit is compared to a high reference (a standard gasoline known to have a high deposit) and as a low reference (an unleaded base fuel which is known to have a low deposit). Practice of this invention desirably permits attainment of a CCDST rating below that of the low reference.

THE COMBUSTION CHAMBER DEPOSIT SCREEN TEST (CCDST)

The Combustion Chamber Deposit Screening Test (CCDST) determines whether the additive is effective as a deposit control additive to prevent octane requirement increase. In this test, the additive sample is dissolved in unleaded gasoline in a concentration of 100 pounds per thousand barrels. In a nitrogen/air environment the gasoline is then atomized and sprayed onto a heated aluminum tube. After 100 minutes, the deposits which have formed on the tube are weighed. Gasolines which form larger amounts of deposits on the heated aluminum tube cause the greatest octane requirement increase (ORI) when employed in an internal combustion engine.

DESCRIPTION OF SPECIFIC EMBODIMENT

Practice of the process of this invention will be apparent to those skilled in the art from the following wherein, as elsewhere in this description, all parts are parts by weight unless otherwise specified. An asterisk indicates a control example.

EXAMPLE I*-II-III

In this series of runs, the hydrocarbon fuel is an unleaded base fuel (UBF), containing a commercial additive package free of ORI additives, having the following properties:

TABLE

| Property | Value |
|---|---|
| ibp (°F.) | 92 |
| 50% bp (°F.) | 216 |
| 90% bp (°F.) | 334 |
| API Gravity | 61.0 |
| RON | 93.2 |
| MON | 83.3 |

The gasoline contains 30% aromatics, 17% olefins, and 53% saturates.

The UBF is tested in Example I*. The composition tested in Example II is the UBF plus 100 PTB of the Pluronic L-31 brand of poly (oxyethylene) poly (oxypropylene) poly (oxyethylene) polyol set forth as A in the Table Supra.

The composition tested in Example III is the UBF plus 100 PTB of the Pluronic L-63 brand of poly (oxyethylene) poly (oxypropylene) poly (oxyethylene) polyol set forth as B in the Table Supra.

These three compositions were tested for ORI in the Standard ORI Test set forth Supra. The results were as follows:

TABLE

| Example | ORI |
|---|---|
| I* | 5 |
| II | 3 |
| III | 4 |

Example I* is the average of 5 runs.

From the above Table, it is apparent that the compositions of Examples II-III prepared in accordance with this invention desirably permit attainment of a decrease in ORI by as much as 60%.

EXAMPLE IV-VII

In these Examples, the compositions of Examples II-III are tested in the CCDST noted supra. Also tested were a standard gasoline known to yield a large deposit as the high reference (Example VI*) and a standard unleaded gasoline known to yield a low deposit as the low reference (Example VII*). The results were as follows:

TABLE

| Example | Sample of Example | CCDST (mg) |
|---|---|---|
| IV | II | 2.7 |
| V | III | 4.2 |
| VI* | High Reference | 11.2 |
| VII* | Low Reference | 4.9 |

From the above Table, it is apparent that the composition of this invention desirably yields less deposit than the Low Reference formulation. The CCDST is found to correlate with ORI performance as observed in road tests.

Results comparable to those of Examples II–V may be observed if the additive is the following:

TABLE

| Example | Amt (PTB) | Additive $\overline{M}_n$ | a + c | b |
|---|---|---|---|---|
| VIII | 80 | 1750 | 4.4 | 26.9 |
| IX | 90 | 1200 | 3 | 18.4 |
| X | 110 | 950 | 8.4 | 10 |
| XI | 120 | 1200 | 10.4 | 12.8 |

Results comparable to those of Examples II–V may be observed if the hydrocarbon fuel is the following:

TABLE

| Example | Fuel |
|---|---|
| XII | Unleaded summer gasoline - ibp 84° F.; 50% bp 218° F.; 90 bp 347° F.; API Gravity of 58.4 |
| XIII | Unleaded winter gasoline - ibp 80° F.; 50% bp 192° F.; 90% bp 334° F.; API Gravity of 63.8 |

Although this invention has been illustrated by reference to specific embodiments, it will be apparent to those skilled in the art that various changes and modifications may be made which clearly fall within the scope of this invention.

What is claimed:

1. A fuel composition comprising (i) a major portion of a liquid hydrocarbon fuel boiling in the gasoline boiling range; and (ii) a minor effective amount, 0.06 w %–0.9 w % of as additive, of $$HO(CH_2CH_2O)_a(\underset{\underset{CH_3}{|}}{C}HCH_2O)_b(CH_2CH_2O)_cH$$

wherein a+c is 1–11 b is 5–50 and the molecular weight $M_n$ of said additive is 800–2000.

2. A fuel composition as claimed in claim 1 wherein said fuel is a gasoline.

3. A fuel composition as claimed in claim 1 wherein a+c is 2–5.

4. A fuel composition as claimed in claim 1 wherein b is 10–20.

5. A fuel composition as claimed in claim 1 wherein a+c is 2.2 and b is 14.7.

6. A fuel composition as claimed in claim 1 wherein the molecular weight $\overline{M}_n$ of said additive is 900–1750.

7. A fuel composition as claimed in claim 1 wherein said additive is alpha-hydro-omega-hydroxy poly (oxyethylene) poly (oxypropylene) poly (oxyethylene) block polymer.

8. A fuel composition as claimed in claim 1 wherein said additive is present in amount of 0.12 w %–0.6 w % of said fuel composition.

9. A fuel composition comprising a major portion of gasoline; and as additive 0.06 w %–0.9 w % of $$HO(CH_2CH_2O)_a(\underset{\underset{CH_3}{|}}{C}HCH_2O)_b(CH_2CH_2O)_c$$

wherein a+c is 2–5 and b is 10–20 and the molecular weight $\overline{M}_n$ of said additive is 800–2000.

10. The method of treating a liquid hydrocarbon fuel composition boiling in the gasoline range which comprises adding to a major portion of said fuel composition, a minor effective amount, as additive, of $$HO(CH_2CH_2O)_a(\underset{\underset{CH_3}{|}}{C}HCH_2O)_b(CH_2CH_2O)_cH$$

wherein a+c is 1–11 b is 5–50 and the molecular weight $\overline{M}_n$ of said additive is 800–2000.

11. The method of treating a liquid hydrocarbon fuel composition boiling in the gasoline boiling range as claimed in claim 10 wherein said fuel is a gasoline.

12. The method of treating a liquid hydrocarbon fuel composition boiling in the gasoline boiling range as claimed in claim 10 wherein a+c is 2–5.

13. The method of treating a liquid hydrocarbon fuel composition boiling in the gasoline boiling range as claimed in claim 10 wherein b is 10–20.

14. The method of treating a liquid hydrocarbon fuel composition boiling in the gasoline boiling range as claimed in claim 10 wherein a+c is 2.2 and b is 14.7.

15. The method of treating a liquid hydrocarbon fuel composition boiling in the gasoline boiling range as claimed in claim 10 wherein the molecular weight $\overline{M}_n$ of said additive is 900–1750.

16. The method of treating a liquid hydrocarbon fuel composition boiling in the gasoline boiling range as claimed in claim 10 wherein said additive is alpha-hydro-omega-hydroxy poly (oxyethylene) poly (oxypropylene) poly (oxyethylene) block polymer.

17. The method of treating a liquid hydrocarbon fuel composition boiling in the gasoline boiling range as claimed in claim 10 wherein said additive is present in amount of 0.06 w %–0.9 w % of said fuel composition.

18. The method of treating a liquid hydrocarbon fuel composition boiling in the gasoline boiling range as claimed in claim 10 wherein said additive is present in amount of 0.12 w %–0.6 w % of said fuel composition.

19. The method of treating a hydrocarbon liquid fuel composition boiling in the gasoline bearing range which comprises adding to a major portion of said fuel composition, a minor effective amount of 0.2 w %–0.4 w % of $$HO(CH_2CH_2O)_a(\underset{\underset{CH_3}{|}}{C}HCH_2O)_b(CH_2CH_2O)_cH$$

wherein a+c is 1–11 and b is 5–50 and the molecular weight $\overline{M}_n$ of said additive is 900–1750.

* * * * *

44-77

CCC07

AI 116 EX

DF 4,548,616

UNITED STATES PATENT AND TRADEMARK OFFICE

CERTIFICATE OF CORRECTION

PATENT NO. : 4,548,616

DATED : 22 October 1985

INVENTOR(S) : R. L. SUNG &
M. E. DAVIS

It is certified that error appears in the above-identified patent and that said Letters Patent is hereby corrected as shown below:

Column 5, line 57 correct "$\bar{M}_n$"

Column 6, line 58 cancel "bearing", insert "boiling"

Signed and Sealed this

*Eighteenth* Day of *February 1986*

[SEAL]

*Attest:*

DONALD J. QUIGG

*Attesting Officer*

*Commissioner of Patents and Trademarks*